US005259978A

United States Patent [19]

Yoshimura et al.

[11] Patent Number: 5,259,978

[45] Date of Patent: Nov. 9, 1993

[54] TRACTION FLUID COMPOSITION COMPRISING A CYCLOHEXYL DIESTER AND BRANCHED POLY-α-OLEFIN

[75] Inventors: Narihiko Yoshimura; Yasuji Komatsu; Hirotaka Tomizawa, all of Saitama, Japan

[73] Assignee: Toa Nenryo Kogyo, K.K., Tokyo, Japan

[21] Appl. No.: 13,113

[22] Filed: Feb. 1, 1993

Related U.S. Application Data

[63] Continuation of Ser. No. 711,507, Jun. 3, 1991, abandoned, which is a continuation of Ser. No. 303,523, Jan. 27, 1989, abandoned, which is a continuation of Ser. No. 76,596, Jul. 23, 1987, abandoned.

[51] Int. Cl.[5] ..... C10M 105/32; C10M 105/34; C10M 105/36

[52] U.S. Cl. ..... 252/79; 252/73; 252/565

[58] Field of Search ..... 252/79, 73, 76, 56 R, 252/56 S, 57

[56] References Cited

U.S. PATENT DOCUMENTS

| | | | |
|---|---|---|---|
| 2,016,392 | 10/1935 | Schneider | 260/99.40 |
| 2,807,638 | 9/1957 | Morris et al. | 524/285 |
| 3,133,021 | 5/1964 | Gisser et al. | 252/34.7 |
| 3,375,295 | 3/1968 | Rowe | 585/517 |
| 3,440,894 | 4/1969 | Hammann et al. | 252/52 R |
| 3,595,797 | 7/1971 | Duling et al. | 252/73 |
| 3,655,808 | 4/1978 | Driscoll | 585/521 |
| 3,803,037 | 4/1974 | Wygant | 252/32.7 E |
| 3,871,837 | 3/1975 | Bedague et al. | 44/58 |
| 4,178,261 | 12/1979 | Dhein et al. | 252/57 |
| 4,212,816 | 7/1980 | Hentschel et al. | 252/56 S |
| 4,292,187 | 9/1981 | Hentschel et al. | 252/49.5 |
| 4,343,652 | 8/1982 | Allart et al. | 252/56 |
| 4,464,277 | 8/1984 | Cousineau et al. | 44/70 |
| 4,499,000 | 2/1985 | Hentschel et al. | 252/73 |
| 4,507,408 | 3/1985 | Torbus et al. | 523/143 |
| 4,514,190 | 4/1985 | Cousineau et al. | 252/73 |
| 4,519,932 | 5/1985 | Schnur et al. | 252/56 |
| 4,589,990 | 5/1986 | Zehler et al. | 252/56 S |
| 4,606,833 | 8/1986 | Schuettenberg et al. | 252/49 |
| 4,740,321 | 4/1988 | Davis et al. | 252/33.4 |
| 4,758,364 | 7/1988 | Seki et al. | 252/56 R |
| 4,871,476 | 10/1989 | Yoshimura et al. | 252/56 S |
| 4,886,613 | 12/1989 | Yoshimura et al. | 252/79 |
| 4,886,614 | 12/1989 | Yoshimura et al. | 252/79 |
| 5,085,792 | 2/1992 | Narihiko et al. | 252/79 |

FOREIGN PATENT DOCUMENTS

| | | |
|---|---|---|
| 53-127970 | 11/1978 | Japan . |
| 59-68397 | 4/1984 | Japan . |
| 59-191797 | 10/1984 | Japan . |
| 61-19697 | 1/2986 | Japan . |
| 786950 | 11/1957 | United Kingdom . |
| 1593113 | 7/1981 | United Kingdom . |

OTHER PUBLICATIONS

Smalheer et al, "Lubricant Additives", 1967.

Acylation of Glycerol. Ismailov et al., 1971, No. 2, 49-54 (Russ.) From Ref. Zh, Khim, 1972, Abstr. No. 4Zh180.

Corina et al., J. Chromatogr. 260 (1) 51-62, 1983.

*Primary Examiner*—Christine Skane

*Attorney, Agent, or Firm*—M. B. Kapustij; T. J. Shatynski

[57] ABSTRACT

A traction fluid comprising:

(i) a diesteric compound or its derivative represented by the formula

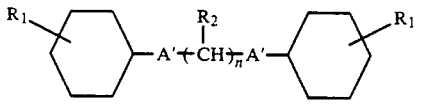

wherein A′ is an ester linkage of —COO— or —OOC—, n is a number having a value of from 1 to 10, $R_1$ is independently selected from hydrogen and alkyl groups containing from 1 to 8 carbons, and $R_2$ is independently selected from hydrogen and alkyl group containing from 1 to 3 carbons; and (ii) from 0.1 to 95% by weight of a branched poly-α-olefin .

7 Claims, No Drawings

TRACTION FLUID COMPOSITION COMPRISING A CYCLOHEXYL DIESTER AND BRANCHED POLY-α-OLEFIN

This is a continuation, of application Ser. No. 711,507, filed June 3, 1991 now abandoned, which is a Rule 62 Continuation of U.S. Ser. No. 303,523 filed Jan. 27, 1989 now abandoned which was a Rule 60 Continuation of U.S. Ser. No. 076,596 filed July 23, 1987 now abandoned.

FIELD OF THE INVENTION

This invention relates to a traction fluid. More particularly, the present invention is concerned with a traction fluid comprising a diester or its derivative having two cyclohexyl rings, and a branched poly-α-olefin as the base oil.

BACKGROUND OF THE INVENTION

Traction drive power transmissions, which transmit power to a driven part through a traction drive mechanism, have attracted attention in the field of automobiles and industrial machinery, and in recent years research and development thereon has progressed. The traction drive mechanism is a power transmitting mechanism using a rolling friction. Unlike conventional drive mechanisms it does not use any gears, which enables a reduction in vibration and noise as well as a smooth speed change in high-speed rotation. An important goal in the automobile industry is improvement in the fuel economy of automobiles. It has been suggested that if the traction drive is applied to the transmission of automobiles to convert the transmission to a continuous variable-speed transmission the fuel consumption can be reduced by 20% or more compared to conventional transmission systems since the drive can always be in the optimum speed ratio. Recent studies have resulted in the development of materials having high fatigue resistance and in the theoretical analysis of traction mechanisms. Regarding the traction fluid, the correlation of traction coefficients is gradually being understood on a level of the molecular structure of the components. The term "traction coefficient" as used herein is defined as the ratio of the tractional force which is caused by slipping at the contact points between rotators which are in contact with each other in a power transmission of the rolling friction type to the normal load.

The traction fluid is required to be comprised of a lubricating oil having a high traction coefficient. It has been confirmed that a traction fluid possessing a molecular structure having a naphthene ring exhibits a high performance. "Santotrack®" manufactured by the Monsanto Chemical Company is widely known as a commercially available traction fluid. Japanese Patent Publication No. 35763/1972 discloses di(cyclohexyl)alkane and dicyclohexane as traction fluids having a naphthene ring. This patent publication discloses that a fluid obtained by incorporating the above-mentioned alkane compound in perhydrogenated (α-methyl)styrene polymer, hydrindane compound or the like has a high traction coefficient. Further, Japanese Patent Laid Open No. 191797/1984 discloses a traction fluid containing an ester compound having a naphthene ring. It teaches that an ester obtained by the hydrogenation of the aromatic nucleus of dicyclohexyl cyclohexanedicarboxylate or dicyclohexyl phthalate is preferable as the traction fluid.

As mentioned above, there has been progress in recent years in the development of continuous variable-speed transmissions. The higher the traction coefficient of the traction fluid the larger the transmission force in the device. This contributes to a reduction in the size of the device with a corresponding reduction in exhaust gas, thereby reducing environmental pollution. Therefore, there is a demand for a fluid having a traction coefficient as high as possible. However, even the use of a traction fluid which exhibits the highest performance of all the currently commercially available fluids in such a traction drive device provides unsatisfactory performance with respect to the traction coefficient and economics. The traction fluid which has been proposed in Japanese Patent Publication No. 35763/1971 contains Santotrack®, which is unsatisfactory with respect to performance and economics.

SUMMARY OF THE INVENTION

A traction fluid comprising (i) a diesteric compound or its derivative shown in the following general formula

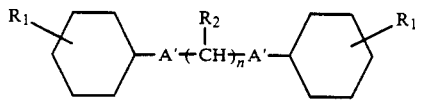

wherein, A′ indicates an ester linkage of —COO— or —OOC—, n is a number within 1 to 10, $R_1$ is independently selected from hydrogen and alkyl groups with 1 to 8 carbons, and $R_2$ is independently selected from hydrogen and alkyl groups containing from 1 to 3 carbons; and (ii) 0.1 to 95% by weight of a branched poly-α-olefin.

DETAILED DESCRIPTION OF THE INVENTION

The present inventors have made extensive and intensive studies with a view to developing a traction fluid which not only exhibits a high traction coefficient but which also is low in cost. As a result, they have found that the incorporation of a diester or its derivative in which two cyclohexyl rings are connected through a linear chain hydrocarbon can provide an economical, high-performance base oil fluid. The present invention is based on this finding.

According to the present invention there is provided a traction fluid comprising (i) a diester or its derivative represented by the following general formula

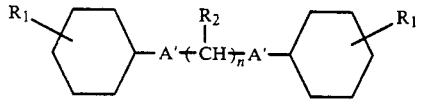

wherein A′ is an ester linkage of —COO— or —OOC—, n is an integer of to 10, $R_1$ is independent selected from a hydrogen atom and alkyl groups having 1 to 8 carbon atoms, and $R_2$ is independently selected from a hydrogen atom and alkyl groups having 1 to 3 carbon atoms: and (ii) 0.1 to 95% by weight of a branched poly-α-olefin.

A first object of the present invention is to provide a high-performance traction fluid having a high traction coefficient. A second object of the present invention is to provide a traction fluid which is not only economical but also readily available and easily applicable to transmissions.

The traction fluid of the present invention comprises a base oil comprised of two components, i.e., component A comprised of a diester or its derivative, and a specific amount of a component B comprised of a branched poly-α-olefin.

In the present invention component A is a diester or its derivative having two cyclohexyl rings and is represented by the above-mentioned structural formula. A' of the ester linkage is —COO— or —OOC—, and the number, n, of the carbon atoms in the hydrocarbon skeleton is 1 to 10, preferably 1 to 4. When n is zero, the traction coefficient is low while when n is 11 or more the viscosity is unfavorably high. This diester or derivative thereof has a viscosity of 5 to 50 cst, preferably 7 to 30 cst at 40° C., and 1 to 10 cst, preferably 2 to 6 cst, at 100° C.

The component A can be prepared by any of the following methods. The first method comprises an esterification reaction of a dihydric alcohol with a cyclohexanecarboxylic acid compound. The dihydric alcohol has 1 to 10 carbon atoms, preferably 1 to 4 carbon atoms. Specifically, examples of the dihydric alcohol include ethylene glycol, 1,3-propanediol, 1,3-butanediol and 1,4-butanediol. Examples of the cyclohexanecarboxylic acid compound include, besides cyclohexanecarboxylic acid, those having an alkyl group with 1 to 8 carbon atoms, e.g., methylcyclohexanecarboxylic acid, ethylcyclohexanecarboxylic acid, etc. Cyclohexanecarboxylic acid is particularly preferred. The esterification reaction is conducted with an alcohol/acid molar ratio of 1:2, or in the presence of an excess amount of the acid. The former method requires the use of a catalyst and has the additional disadvantage that a monoalcohol is produced as the by-product. Therefore, it is preferred that the esterification reaction be conducted in the presence of an excess amount of the acid. Specifically, 1 mol of the dihydric alcohol is reacted with the acid in 2 to 5-fold mol excess (particularly preferred is a 2.5 to 4-fold mol excess). The reaction temperature is about 150° to 250° C., preferably 170° to 230° C., and the reaction time is 10 to 40 hr, preferably 15 to 25 hr. Although the esterification reaction may be conducted under either elevated or reduced pressures, it is preferred that the reaction is conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds the water which forms during the reaction evaporates. The reaction is terminated when the amount of the water reaches, on a mole basis, twice that of the alcohol. The excess acid is neutralized with an aqueous alkaline solution and removed by washing with water. When an acid which is difficult to extract with an alkali washing is used the reaction is conducted using the acid in an amount of 2 to 2.5-fold mol excess over the alcohol in the presence of a catalyst. Examples of the catalyst include phosphoric acid, p-toluenesulfonic acid and sulfuric acid. The most preferable catalyst is phosphoric acid because it enhances the reaction rate and increases the yield of the ester. The reaction product is finally distilled under reduced pressure to remove water and the solvent thereby obtaining the diester compound of the present invention.

The second method of producing the component A of the present invention comprises esterification of a cyclohexanol compound with a dicarboxylic acid having 3 to 12 carbon atoms. Examples of the cyclohexanol compound include, besides cyclohexanol, those having an alkyl group with 1 to 8 carbon atoms, e.g., methylcyclohexanol and tertbutylcyclohexanol. Cyclohexanol is particularly preferred. The dicarboxylic acid includes one having 3 to 12 carbon atoms in its main chain, preferably one having 3 to 6 carbon atoms in its main chain. Examples of the dicarboxylic acid include malonic acid, succinic acid and glutaric acid. The esterification reaction is conducted in an alcohol/acid molar ratio of 2:1 or in the presence of an excess amount of the alcohol. In the former method, there is a possibility of forming a monocarboxylic acid as the by-product. Therefore, it is preferred that the esterification reaction is conducted in the presence of an excess amount of the alcohol. Specifically, 1 mol of the dicarboxylic acid is reacted with the alcohol in 2.5 to 5-fold mol excess. The reaction temperature is about 150° to 250° C., preferably 170° to 230° C., and the reaction time is 10 to 40 hr, preferably 15 to 25 hr. Although the esterification reaction may be conducted under either elevated or reduced pressures, it is preferred that the reaction be conducted at atmospheric pressure from the standpoint of ease of reaction operation. An alkylbenzene such as xylene or toluene can be added in a suitable amount as a solvent. The addition of the solvent enables the reaction temperature to be easily controlled. As the reaction proceeds the water which has been formed during the reaction evaporates. The reaction is terminated when the amount of the water reaches twice by mol that of the alcohol. Phosphoric acid, p-toluenesulfonic acid or sulfuric acid can be used as a catalyst. The most preferable catalyst is phosphoric acid because it enhances the reaction rate and increases the yield of the ester. The reaction product is finally distilled under reduced pressure to remove the water, solvent and excess alcohol thereby obtaining the diester compound of the present invention.

The poly-α-olefin component B has either a quaternary carbon atom or a tertiary carbon atom in its main chain and is a polymer of an α-olefin having 3 to 5 carbon atoms or the hydrogenation product thereof. Examples of the poly-α-olefin include polypropylene, polybutene, polyisobutylene and polypentene and the hydrogenation products thereof. The polyisobutylene is represented by the following structural formula:

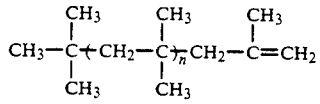

The hydrogenation product of the polyisobutylene is represented by the following structural formula:

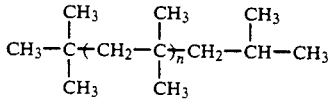

In the above-mentioned formulae, the degree of polymerization, n, is 6 to 200.

Although the polybutene and polyisobutylene used may be commercially available ones, they may also be produced by conventional and well known polymerization methods. The hydrogenation product thereof is produced by reacting polyisobutylene or the like in the presence of hydrogen. The molecular weight of the poly-α-olefin is preferably in the range of 500 to 10,000, more preferably in the range of 900 to 5,000. The molecular weight can be adjusted by suitable methods such as decomposition of a poly-α-olefin having a high molecular weight and mixing of a poly-α-olefins having different molecular weights. Although an α-olefin copolymer (OCP) is a type of a poly-α-olefin, it is unsuited for use as the component B in the present invention. This is because OCP is obtained by polymerization of two or more α-olefins and has such a structure that these olefins are irregularly linked, as opposed to the polybutene etc. of the present invention which have a regular gem-dialkyl structure.

The component A in the present invention, e.g., a diester of succinic acid with cyclohexanol, exhibits a traction coefficient of 0.102 to 0.106, while the component B, e.g., polybutene, exhibits a traction coefficient of 0.075 to 0.085.

Since the component A in the present invention exhibits a high traction coefficient, the use of the component A alone in a traction drive device results in a high performance. However, a further improved traction fluid can be obtained by blending the component A with 0.1 to 95% by weight, particularly 10 to 70% by weight, of the component B. Specifically, although the component B has a lower traction coefficient than that of the component A, the gem-dialkyl group in the component B cooperates with the cyclohexyl ring in the component A to exhibit a synergistic effect (with respect to improvement in traction coefficient). Further, since the component B is inexpensive and exhibits excellent viscosity characteristics, a traction fluid can be economically obtained by blending component A with 0.1 to 95% by weight of component B without lowering the traction coefficient.

Various additives may also be added to the traction fluid of the present invention depending upon their applications. Specifically, when the traction device undergoes a high temperature and a large load at least one additive selected from among an antioxidant, a wear inhibitor and a corrosion inhibitor may be added in an amount of 0.01 to 5% by weight. Similarly, when a high viscosity index is required a known viscosity index improver is added in an amount of 1 to 10% by weight. However, since the use of polyacrylate and olefin copolymers lowers the traction coefficient, it is preferred that, if present, they be used in an amount of 4% or less by weight.

The term "traction fluid" as used in the present invention is intended to mean a fluid for use in devices which transmit a rotational torque through point contact or line contact, or for use in transmissions having a similar structure. The traction fluid of the present invention exhibits a traction coefficient higher than those of conventionally known fluids, i.e., exhibits a traction coefficient 5 to 15% higher than those of the conventional fluids, although the value varies depending on the viscosity. Therefore, the traction fluid of the present invention can be advantageously used for relatively low power drive transmissions including internal combustion engines of small passenger cars, spinning machines and food producing machines, as well as large power drive transmissions such as industrial machines etc.

The traction fluid of the present invention is remarkably superior in traction coefficient relative to conventional fluids. The reason why the traction fluid of the present invention exhibits a high traction coefficient is not yet fully understood. However, basically, the reason is believed to reside in the unique molecular structure of the traction fluid of the present invention.

The component A of the traction fluid of the present invention comprises a diester. The diester has two cyclohexyl rings in its molecule. The two ester linkages bring about an interdipolar force between the molecules. It is believed that the interdipolar force serves to bring the fluid into a stable glassy state under high load conditions, thereby increasing the shearing force. Further, the traction fluid of the present invention possesses a structure having suitable flexibility because the carbon atoms in the basic skeleton are connected to the two cyclohexyl rings through an ester linkage. Furthermore, the component B in the traction fluid of the present invention has a quaternary carbon atom of the gem-dialkyl type. Therefore when the traction device is under high load conditions the cyclohexyl rings are firmly engaged, like gears, with the gem-dialkyl portions of the quaternary carbon of the component B, while when the device is released from the load this engagement is quickly broken thereby causing fluidization.

The following examples are provided for illustrative purposes only and are not to be construed as limiting the invention herein described.

EXAMPLES 1-13

Diester $A_1$ of the present invention was synthesized by the following method.

First, 250 g of cyclohexanol and 104 g of malonic acid (i.e., 0.4 mol per mol of cyclohexanol) were charged into a reactor, and phosphoric acid was added in an amount of 1% by weight based on the total weight of the reactants. The reactor was heated at 180° C. The contents of the reactor were allowed to react at a temperature in the range of 180° C. to 210° C. under atmospheric pressure. The reaction was stopped at a point when the water generated during the reaction amounted to twice, by mol, of the amount of the malonic acid. The reaction mixture was washed with an alkaline solution to remove unreacted compounds, i.e., cyclohexanol and phosphoric acid, from the mixture of the reaction product, i.e., an ester of cyclohexanol with malonic acid, the unreacted compounds and phosphoric acid, followed by vacuum distillation, thereby isolating a pure diester ($A_1$).

Using the same method as described above diesters $A_2$ and $A_3$ of the present invention were synthesized using the following raw materials:

$A_2$ . . . ethylene glycol and cyclohexanecarboxylic acid (in excess acid)

$A_3$ . . . succinic acid and cyclohexanol

The diesters thus produced were each blended with polybutene having an average molecular weight of 900 to 2350, followed by measurement of traction coefficient. The conditions of measurement of the traction coefficient were as follows:

measuring equipment: Soda-type four-roller traction testing machine test conditions: a fluid temperature of 20° C.; a roller temperature of 30° C.; a mean Hertzian pressure of 1.2 GPa; a rolling velocity of 3.6 m/s; and a slipping ratio of 3.0%.

The traction fluid of the present invention was found to be remarkably superior in traction performance to the conventional fluids as shown in Table 1.

COMPARATIVE EXAMPLES 1 TO 9

The traction coefficients of the following traction fluids were measured under the same conditions as those used in the above examples: a traction fluid consisting of 100% by weight of the component B; traction fluids obtained by blending the component $A_1$ to $A_3$ with to 30% by weight of OCP or PMA; and a commercially available traction fluid (Santotrack ®). The results are shown in Table 1. As can be seen from Table 1, all the comparative samples exhibited traction coefficients 10 to 15% smaller than that of the diester compound of the present invention. It is noted in this connection that an olefin copolymer, i.e., copolymer having an average molecular weight of 150,000 to 300,000 of ethylene with propylene was used as OCP, while polymethacrylate having an average molecular weight of 50,000 to 300,000 was used as PMA.

TABLE 1

| | A | | B | | Viscosity (cst) | | Viscosity | Traction |
|---|---|---|---|---|---|---|---|---|
| | Loadings % | | M.W. | Loadings % | 40° C. | 100° C. | index | coefficient |
| Reference | | | | | | | | |
| 1 | $A_1$ | | — | 0 | 7.4 | 2.05 | 55 | 0.102 |
| 2 | $A_2$ | | — | 0 | 12.2 | 2.97 | 93 | 0.091 |
| 3 | $A_3$ | | — | 0 | 23.5 | 3.86 | 4.9 | 0.104 |
| Example | | | | | | | | |
| 1 | $A_1$ | 90 | 900 | 40 | 60.9 | 8.69 | 116 | 0.112 |
| 2 | " | 80 | 1260 | 20 | 23.2 | 4.69 | 122 | 0.112 |
| 3 | " | 70 | " | 30 | 46.9 | 7.65 | 130 | 0.113 |
| 4 | " | 60 | " | 40 | 100.0 | 12.60 | 119 | 0.113 |
| 5 | " | 90 | 2350 | 10 | 16.1 | 4.8 | 252 | 0.111 |
| 6 | $A_2$ | 70 | 1260 | 30 | 78.2 | 10.80 | 126 | 0.102 |
| 7 | " | 60 | " | 40 | 155.0 | 16.90 | 117 | 0.103 |
| 8 | $A_3$ | 80 | 900 | 20 | 50.1 | 6.53 | 73 | 0.105 |
| 9 | " | 90 | 1260 | 10 | 39.7 | 5.75 | 78 | 0.106 |
| 10 | " | 80 | " | 20 | 71.9 | 8.60 | 90 | 0.108 |
| 11 | " | 70 | " | 30 | 123.0 | 12.89 | 91 | 0.112 |
| 12 | " | 60 | " | 40 | 269.3 | 20.13 | 86 | 0.109 |
| 13 | " | 80 | 2350 | 20 | 125.9 | 13.61 | 104 | 0.111 |
| Comp. Ex. | | | | | | | | |
| 1 | | 0 | 900 | 100 | 11600 | 240 | *108 | 0.081 |
| 2 | | 0 | 1260 | 100 | 32000 | 630 | *155 | 0.080 |
| 3 | $A_1$ | 96 | OCP | 5 | 17.4 | 4.51 | 187 | 0.100 |
| 4 | " | 90 | " | 10 | 51.6 | 12.4 | 248 | 0.098 |
| 5 | " | 96 | PMA | 10 | 16.7 | 4.32 | 180 | 0.098 |
| 6 | " | 90 | " | 30 | 71.4 | 15.7 | 235 | 0.092 |
| 7 | $A_2$ | 90 | OCP | 10 | 48.2 | 16.9 | 366 | 0.085 |
| 8 | $A'_3$ | 90 | " | 10 | 95.3 | 23.5 | 277 | 0.099 |
| 9 | | | Santotrack | | 13.8 | 2.99 | 46 | 0.087 |

Note: *values obtained through calculation using an equation with respect to a kinetic viscosity of 17 to 43 cst.

The traction fluid of the present invention which comprises a component A having two cyclohexyl rings and linear-chain hydrocarbons as the skeleton and a specific amount of a component B comprised of a branched poly-α-olefin not only exhibits an extremely high traction coefficient but also is inexpensive and exhibits excellent viscosity characteristics.

Therefore, the use of the traction fluid of the present invention in a power transmission device, particularly a traction drive device, leads to a remarkable increase in shearing force under a high load which in turn enables reduction in size of the device and reduced cost of the device.

What is claimed is:

1. A traction fluid comprising (i) at least one diester or its derivative represented by the general formula:

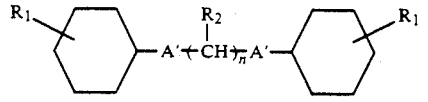

where A' is an ester linkage of —COO— or —OOC—, n is an integer of 1 to 10, $R_1$ is independently selected from the group consisting of hydrogen and alkyl groups having 1 to 8 carbon atoms, and $R_2$ is independently selected from the group consisting of hydrogen and alkyl groups having 1 to 3 carbon atoms; and (ii) 10 to 40% by weight of at least one branched poly-α-olefin selected from the group consisting of branched poly-α-olefins having an average molecular weight of from 900 to 5000.

2. A traction fluid according to claim 1 wherein said branched poly-α-olefin is polyisobutene.

3. A traction fluid of claim 1 wherein $R_1$ is independently selected from the group consisting of a hydrogen atom and alkyl groups having 1 to 4 carbon atoms.

4. A traction fluid of claim 1 wherein n is an integer of 1 to 4.

5. A traction fluid of claim 1 wherein $R_2$ is independently selected from the group consisting of hydrogen or a methyl group.

6. A traction fluid according to claim 5 wherein $R_2$ is hydrogen.

7. A traction fluid according to claim 1 wherein $R_2$ is hydrogen.

* * * * *